US012723348B2

(12) United States Patent
Heepe et al.

(10) Patent No.: US 12,723,348 B2
(45) Date of Patent: Sep. 1, 2026

(54) METHOD FOR DYEING A HOOK-AND-LOOP FASTENER STRAP

(71) Applicant: Gottlieb Binder GmbH & Co. KG, Holzgerlingen (DE)

(72) Inventors: Lars Heepe, Tübingen (DE); Konstantinos Poulakis, Hildrizhausen (DE); Markus Schneider, Esslingen (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 203 days.

(21) Appl. No.: 18/805,429

(22) Filed: Aug. 14, 2024

(65) Prior Publication Data

US 2025/0059706 A1 Feb. 20, 2025

(30) Foreign Application Priority Data

Aug. 15, 2023 (DE) ..... 102023207843.0

(51) Int. Cl.
*D06P 1/00* (2006.01)
*D06P 1/39* (2006.01)
(Continued)

(52) U.S. Cl.
CPC ..... *D06P 1/39* (2013.01); *D06P 1/0032* (2013.01); *D06P 5/02* (2013.01); *D06P 3/241* (2013.01)

(58) Field of Classification Search
CPC .. D06P 1/39; D06P 1/0032; D06P 5/02; D06P 3/241; D06P 5/151; D06P 5/12;
(Continued)

(56) References Cited

U.S. PATENT DOCUMENTS 5,230,709 A * 7/1993 Holfeld ..... D06P 3/241 8/680
5,366,511 A * 11/1994 Holfeld ..... D06P 3/16 8/680
(Continued)

FOREIGN PATENT DOCUMENTS

CN 113832705 A 12/2021
DE 196 10 120 C2 7/2002
(Continued)

OTHER PUBLICATIONS

"CHT Smart Chemistry With Character", Textile Solutions, p. 41.

*Primary Examiner* — Eisa B Elhilo
(74) *Attorney, Agent, or Firm* — Orbit IP, LLP; Marc G. Martino

(57) ABSTRACT

A method for dyeing a hook-and-loop fastener strap is disclosed. The hook-and-loop fastener strap continuously passes through a basic or neutral dyeing solution in a dyeing device. The dyeing solution attaches itself to the hook-and-loop fastener strap. The dyeing solution has a dye that binds to the hook-and-loop fastener strap only when the dyeing solution is in an acidic state. After passing through the dyeing device, the hook-and-loop fastener strap with the deposited dyeing solution is passed through a damper, causing the dyeing solution to become acidic. The dye adheres to the hook-and-loop fastener strap to dye the hook-and-loop fastener strap. A dyeing system for implementing the method is also disclosed.

16 Claims, 2 Drawing Sheets

(51) Int. Cl.
*D06P 5/02* (2006.01)
*D06P 3/24* (2006.01)

(58) Field of Classification Search
CPC .. A44B 18/0069; D06B 3/10; D06B 19/0005; F26B 23/04
USPC ..... 8/504, 516
See application file for complete search history.

(56) References Cited

U.S. PATENT DOCUMENTS

| | | | | |
|---|---|---|---|---|
| 6,056,790 | A * | 5/2000 | Clark | D06P 1/0008 8/930 |
| 7,398,660 | B2 | 7/2008 | Shalev et al. | |

FOREIGN PATENT DOCUMENTS

| | | | | |
|---|---|---|---|---|
| DE | 103 34 675 | A1 | 2/2005 | |
| EP | 0 043 984 | A1 | 1/1982 | |
| EP | 1502988 | A1 * | 2/2005 | D06P 5/30 |
| JP | 2000154480 | A * | 6/2000 | D06P 1/39 |
| JP | 2005-187996 | A | 7/2005 | |
| WO | 2008/111038 | A2 | 9/2008 | |

* cited by examiner

METHOD FOR DYEING A HOOK-AND-LOOP FASTENER STRAP

CROSS-REFERENCE TO RELATED APPLICATIONS

This application claims priority to German Patent Application Number DE 10 2023 207 843.0, filed Aug. 15, 2023, the entire contents of which are hereby incorporated in full by this reference.

DESCRIPTION

Field of the Invention

The invention concerns a method for dyeing a Velcro® strap having projecting hooks, mushrooms and/or loops. The invention further concerns a dyeing system for implementing the method.

Velcro® is a trademark for a specific brand of hook-and-loop fasteners (i.e., hook-and-pile fasteners, touch fasteners) which allow two surfaces to be repeatedly fastened and unfastened, useful for clothing, bags, shoes or other various purposes. The fastener consists of two components: typically, two fabric strips (or, alternatively, smaller segments) which are attached (sewn or otherwise adhered) to the opposing surfaces designed to be fastened together. The first component features tiny hooks and the second component features tiny loops. When the two are pressed together, the hooks catch in the loops and the two pieces fasten or bind temporarily until separated. Each reference to Velcro® in this specification is a reference generally to a hook-and-loop fastener.

Background of the Invention

A method for dyeing textile goods is known from DE 196 10 120 C2. DE 103 34 675 A1 concerns a method for dyeing or printing adhesive tape fasteners. A method for fixing paint to a surface using selected pressure and temperature ranges is disclosed in WO 2008/111038 A2.

EP 0 043 984 A1 concerns a dyeing method for dyeing or printing fiber blends of cellulose and polyester fibers using acid donors.

It is known from prior art to dye Velcro® straps roll by roll in dyeing troughs. The disadvantage of the known methods is that they are comparatively time-consuming, in particular due to the replacing of the Velcro® straps in the dyeing troughs and any post-processing required to achieve an even application of dye on the Velcro® straps.

Alternatively, to the roll-by-roll dyeing described above, an attempt was made to dye Velcro® straps continuously. The problem here, however, is that Velcro® straps have projecting filigree hooks, mushrooms and/or loops that should have the same color shade as the base material connected to them. To achieve a uniform dyeing of these filigree structures and the associated more solid material, attempts were made to use thickening agents, but without achieving a uniform dyeing.

SUMMARY OF THE INVENTION

Object of the Invention

The object of the invention is to provide a method for dyeing a Velcro® strap in which a uniform dyeing of the Velcro® strap is achieved in a time-saving and reliable manner. The object of the invention is further to provide a dyeing system for implementing the method.

DESCRIPTION OF THE INVENTION

According to the invention, the object is solved by a method in accordance with the first independent claim. The object is further achieved by a dyeing system in accordance with another independent claim.

According to the invention the method has the following sequentially performed steps:

a) continuously passing a Velcro® strap through a dyeing device to apply a dyeing solution with a pH value of at least 7 to the Velcro® strap, wherein the dyeing solution has a dye, wherein the dye is formed in particular as an acid dye which binds to the Velcro® strap at a pH value of less than 7;

b) continuously passing the Velcro® strap with the applied dyeing solution through a damper, wherein the pH value of the dyeing solution in the damper is lowered to below 7 to increase adhesion of the dye to the Velcro® strap.

The dye in the dyeing solution does not bind immediately to the Velcro® strap when the dye comes into contact with the Velcro® strap. Rather, the dye first attaches itself to the Velcro® strap, whereby the dye is distributed uniformly over the surface of the Velcro® strap, for example by diffusion. The period during which the dye can spread on the surface of the Velcro® strap is flexibly adjustable by leaving the Velcro® strap in the dyeing device for a desired period of time. This ensures uniform distribution of the dye on the surface of the Velcro® strap.

The damper increases the adhesion of the dye to the Velcro® strap without affecting the uniform distribution of the dye on the Velcro® strap. This reliably results in a uniform dyeing of the Velcro® strap. Increasing the adhesion of the dye to the Velcro® strap is achieved, in particular, by lowering the pH value in the damper to below 7. Increasing the dye's adherence to the Velcro® strap is achieved in particular by the dye binding to the Velcro® strap at a pH value below 7.

In the event that the dyeing solution has several dyes, it is possible to prevent the dyes of the dyeing solution in the dyeing device from adhering to the Velcro® strap at different rates (in particular from binding to the Velcro® strap), so that the concentration of the dyes on the Velcro® strap deviates from a desired concentration of the dyes, resulting in an undesirable overall color of the Velcro® strap. In addition, the water consumption of the method is comparatively low, meaning that the dyeing of the Velcro® strap is done in an environmentally friendly and sustainable way.

In particular, the Velcro® strap is one of two straps of a Velcro® fastener. In addition to the Velcro® strap, the corresponding Velcro® fastener has a further Velcro® strap that is complementary to the Velcro® strap in order to create a Velcro® connection between the Velcro® strap and the other Velcro® strap.

In particular, Bemacid Yellow®, Bemacid Red® and/or Bemacid Marine® are used as dyes. Preferred dyes, in particular acid dyes, are Amido Black 10 B, in particular with the empirical formula disodium 4-amino-5-hydroxy-3-[(4-nitrophenyl)diazenyl]-6-(phenyldiazenyl)-2,7-naphthalene disulfonate), Metanil Yellow 36, in particular with the empirical formula sodium 3-[(4-anilinophenyl)diazenyl] benzenesulfonate), Acid Blue 25, in particular with the empirical formula 1-amino-4-anilino-9,10-dioxoanthracene-2-sulfonic acid (Na salt)) and/or Acid Green 22, in particular with the empirical formula sodium 3-{[{(1Z, 4E)-4-[(2-chlorophenyl){4-[ethyl(3-sulfonatobenzyl)amino]-2-methylphenyl}methylene]-3-methyl-2,5-cyclohexadien-1-ylidene}(ethyl)ammonio]methyl}benzenesulfonate.

Examples of acid dyes are

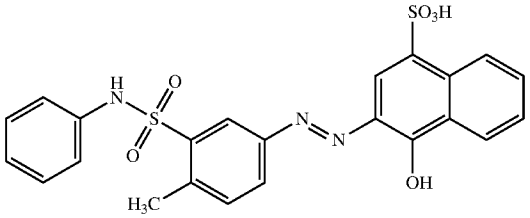

C.I. Acid Orange 19

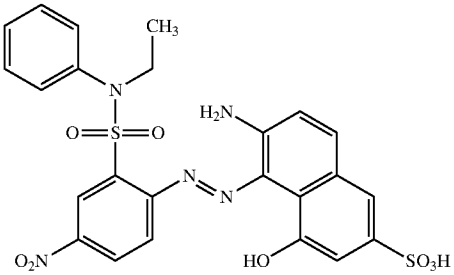

C.I. Acid Blue 117

During the method steps a) and b) are carried out in particular without interruption, i.e., without any method steps carried out in between.

In a preferred variant of the method, the dyeing solution has an acid donor designed to release acid at a critical value of a control parameter of the damper to lower the pH of the dyeing solution in the damper.

Acid donors are, in particular, chemical compositions that can form free acids in aqueous solution.

The carboxylic acid esters are such compounds in particular. During the acid-catalyzed hydrolysis of the carboxylic acid esters, in particular the corresponding carboxylic acid is released, which can lead to a lowering of the pH. The acid-catalyzed hydrolysis of esters shows, in particular, a temperature dependence; the reaction rate increases with increasing temperature.

Meropan EF® is, in particular, a carboxylic-acid-ester-based acid donor that can lower the pH value of a solution, in particular the dyeing solution, at higher temperatures.

In particular, carboxylic acid esters are organic compounds that are formed by a reaction between a carboxylic acid and an alcohol, known as esterification. In particular, water is separated as a by-product in this reaction.

$$R1\text{COOH}+R2\text{OH} \rightarrow R1\text{COOR2}+\text{H2O}$$

In particular, esterification is a balance reaction. In particular, the reverse reaction of esterification is ester cleavage, also known as ester hydrolysis, in which the ester is cleaved into the corresponding carboxylic acid and alcohol.

During the hydrolysis of esters, the pH value in particular changes, and the nature of the change depends on whether the hydrolysis takes place in an acidic or basic medium.

In acid-catalyzed hydrolysis for ester cleavage, the ester, in particular, is treated with water in the presence of an acid, such as sulfuric acid. The balance of this reaction is, in particular, on the side of the carboxylic acid and the alcohol, particularly if water is used in excess. The acid-catalyzed hydrolysis leads, in particular, to the formation of a free carboxylic acid, which can lower the pH value, as carboxylic acids are weak acids and partially dissociate in aqueous solution.

In particular, the general reaction equation is:

$$R1\text{COOR2}+\text{H2O} \rightarrow R1\text{COOH}+R2\text{OH}$$

In particular, the Arrhenius equation describes the relationship between the rate constant and the temperature:

$$k = A \cdot e^{-\frac{Ea}{RT}}$$

In particular:

(A) pre-exponential factor (frequency factor), (Ea) activation energy, (R) universal gas constant, (T) absolute temperature in Kelvin.

In particular, the acid-catalyzed hydrolysis of esters also shows a temperature dependence. The reaction rate increases with temperature, in particular, as the protonation of the carbonyl group of the ester and the subsequent attack of the water on the positivized carbon are facilitated.

One of the following substances is preferably used as an acid donor: Sodium chloroacetate, sodium dichloroacetate, 3-Chloropropionic acid sodium salt, monochloro racetamide, butyrolactone, Lauryl sulphate, hexadecyl sulphate, octadecyl sulphate, 2-ethylhexyl sulphate, butyl sulphate, butyl glycol sulphate, butyl diglycol sulphate, C1-C4 alkyl ester of phosphoric acid and/or phosphorous acid, trimethyl phosphate, triethyl phosphate, tris-(hydroxyethyl)phosphate, dimethyl phosphate, diethyl phosphite, dipropyl phosphite, di-isopropyl phosphite, dibutyl phosphite, methane phosphonic acid dimethyl ester, ethanophosphonic acid diethyl ester, phosphonopropionic acid trimethyl ester, cyanethane phosphonic acid dimethyl ester, cyanomethane phosphonic acid methyl ester, hydroxyethane and/or hydroxymethane phosphonic acid dimethyl ester, 2-chloroethane phosphonic acid dimethyl ester, 2-chloroethane phosphonic acid diethyl ester and/or phosphonosuccinic acid tetra-methyl ester.

Meropan RLS® is used, in particular, as an acid donor.

In a further development of the aforementioned variant of the method, the control parameter is the temperature of the dyeing solution in the damper, wherein the critical value of the control parameter is in particular in the range from 70° C. to 105° C. The temperature as a control parameter is comparatively simple to set.

The temperature in the damper rises to over 90° C., in particular, and the pH value of the dyeing solution preferably drops to a value of less than 6. The above-mentioned acid dyes with the sulfonic acid residue as hydrophilic substituent are completely dissociated, in particular, in this pH range. Here, in particular, the amino groups of polyamide fibers of the Velcro® strap are also present as ammonium cations. The dye anions form essentially salt-like bonds with the functional groups of the fiber, in particular, during the actual dyeing process.

In an advantageous variant of the method, the dyeing solution has a first masking fabric having an affinity to the dye in the dyeing device at the initial value of the control parameter which is greater than the affinity of a Velcro® material of the Velcro® strap to the dye, wherein in the damper at the critical value of the control parameter, the affinity of the first masking fabric to the dye is less than the affinity of the Velcro® material of the Velcro® strap to the dye.

Within the scope of the invention, the affinity of a substance to another substance is understood, in particular, as the tendency of the substances to bind to one another. The first masking fabric attaches itself to molecules of the dye in the dyeing device, thereby preventing the dye from adhering to the Velcro® material of the Velcro® strap. As a result, the first masking fabric additionally prevents the dye from binding to the Velcro® strap in the dyeing device. In the damper, the first masking fabric releases the dye, allowing the dye to bind to the Velcro® strap.

The Velcro® strap consists, in particular, of the Velcro® material of the Velcro® strap with the aforementioned affinity or binding properties. The Velcro® material is preferably fibrous. In particular, Sarabid IPD® is used as the first masking fabric.

Preferred is a variant of the method in which the dyeing solution has a second masking fabric which, in the dyeing device at the initial value of the control parameter, has an affinity for a Velcro® material of the Velcro® strap which is greater than the affinity of the dye for the Velcro® material of the Velcro® strap, which is greater than the affinity of the dye for the Velcro® material of the Velcro® strap, wherein in the damper at the critical value of the control parameter the affinity of the second masking fabric for the Velcro® material of the Velcro® strap is less than the affinity of the dye for the Velcro® material of the Velcro® strap.

The second masking fabric attaches to the Velcro® material of the Velcro® strap in the dyeing device more quickly than the dye attaches to the Velcro® material of the Velcro® strap. As a result, the second masking fabric additionally prevents the dye from binding to the Velcro® strap in the dyeing device. In the damper, the second masking fabric is replaced by the dye, allowing the dye to bind to the Velcro® strap. The Velcro® strap consists, in particular, of Velcro® material. Sarabid IPF® is used in particular as a second masking fabric.

A variant of the method in which the Velcro® strap is washed in a first washing apparatus at a temperature of 40° C. to 70° C., in particular, before step a), is advantageous. This removes dirt residue from the Velcro® strap. In particular, avivage agents are washed out of the Velcro® strap.

In a further development of the aforementioned variant of the method, the Velcro® strap is washed in a second washing apparatus at a temperature of 70° C. to 100° C., in particular before step a), after the Velcro® strap has been washed in the first washing apparatus. This relieves tension in the Velcro® strap, especially in the textile fabric of the Velcro® strap. As a rule, changes are made to the dimensions of the Velcro® strap at the same time, which changes the shape, appearance and/or functionality of the Velcro® strap. The Velcro® strap is particularly supple and flexible.

In one embodiment of the aforementioned further development, the Velcro® strap is washed in a third washing apparatus at a temperature of 20° C. to 40° C., in particular before step a), after the Velcro® strap has been washed in the second washing apparatus. The Velcro® strap undergoes quenching, which maintains the supple and flexible condition of the Velcro® strap for the subsequent process steps.

A variant of the method in which the control parameter is the temperature of the dyeing solution is advantageous, wherein the critical value of the control parameter in the damper is, in particular, in the range from 70° C. to 105° C. Preferably, the critical value of the control parameter in the method is in the range of 70° C. to 105° C. The temperature is a comparatively easy process parameter to control.

In another variant of the method, the Velcro® strap has polyamide and is made of polyamide in particular. When using polyamide, the pH-controlled binding of dye according to the invention is particularly effective.

In particular, the Velcro® strap has polyamide fibers whose structural formula preferably has at least sections of the following form:

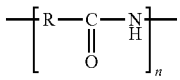

In a preferred variant of the method, the Velcro® strap is continuously passed between two Foulard rollers to remove excess dyeing solution after the Velcro® strap has been passed through the dyeing device according to step a) and before the Velcro® strap is passed through the damper according to step b).

A sufficiently large gap is formed between the Foulard rollers so that the Velcro® strap can be fed through the gap without damaging or destroying the structures of the Velcro® strap, in particular the loops, mushrooms and/or hooks. This further improves the even distribution of the dye on the Velcro® strap.

In a further variant of the method, the dyeing solution has an alkali, in particular soda, so that the pH of the dyeing solution in the dyeing device is at least 7.

In a preferred variant of the method, the dyeing solution has a defoamer. This prevents the formation of foam when the Velcro® strap is dyed. Such foaming can have a detrimental effect on the even distribution of the dye when applying the dye in the dyeing device and/or binding the dye to the Velcro® strap in the damper. Kollasol CDS® in particular is used as a defoamer.

A variant of the method in which the Velcro® strap passes through a surge drum as it leaves the damper is advantageous. In particular, the surge drum is a water container that is filled with water. The water reservoir is preferably located in an output of the damper, wherein the Velcro® strap is passed through the surge drum as it exits the damper. The transparency of the water in the surge drum is an indicator of whether the dye is sufficiently well bound to the Velcro® strap.

In an advantageous variant of the method, the Velcro® strap passes through a vacuum extractor. The vacuum extractor ensures quick and even dehumidification and cleaning of the Velcro® strap. The vacuum extractor is particularly effective on both the top and the underside of the Velcro® strap.

A preferred variant of the method is one in which the Velcro® strap is dried using infrared radiation. The infrared radiation causes the Velcro® strap to dry quickly and evenly.

A variant of the method in which the thickness of the layer of dye on the Velcro® strap does not exceed a predetermined maximum thickness and/or does not fall below a predetermined minimum thickness over a predetermined length of the Velcro® strap after passing through the method is advantageous. This results in a particularly homogeneous distribution of the dye on the Velcro® strap.

A dyeing system for carrying out a method as described above has the following features:

I. A dyeing device with a dyeing solution having a pH value of at least 7, wherein the dyeing solution has a dye, wherein the dye is formed in particular as an acid dye which binds to the Velcro® strap at a pH value of less than 7;

II. A damper, wherein the damper is configured to lower the pH of the dyeing solution to below 7 to increase adhesion of the dye to the Velcro® strap.

III. A Velcro® strap, wherein the Velcro® strap is passed through the dyeing device and the damper.

The device can be used to achieve uniform coloring of the Velcro® strap.

The method according to the invention optionally also includes a step in which the dyeing solution is slightly thickened, in particular, with Tubivis Star®.

Further advantages of the invention can be found in the description and the drawings. Likewise, according to the invention, the aforementioned features and those which are to be explained below can each be used individually or together in any desired combinations. The embodiments shown and described are not to be understood as an exhaustive list, but, rather, have an exemplary character for the description of the invention.

DETAILED DESCRIPTION OF EMBODIMENTS OF THE INVENTION

Figure 1:
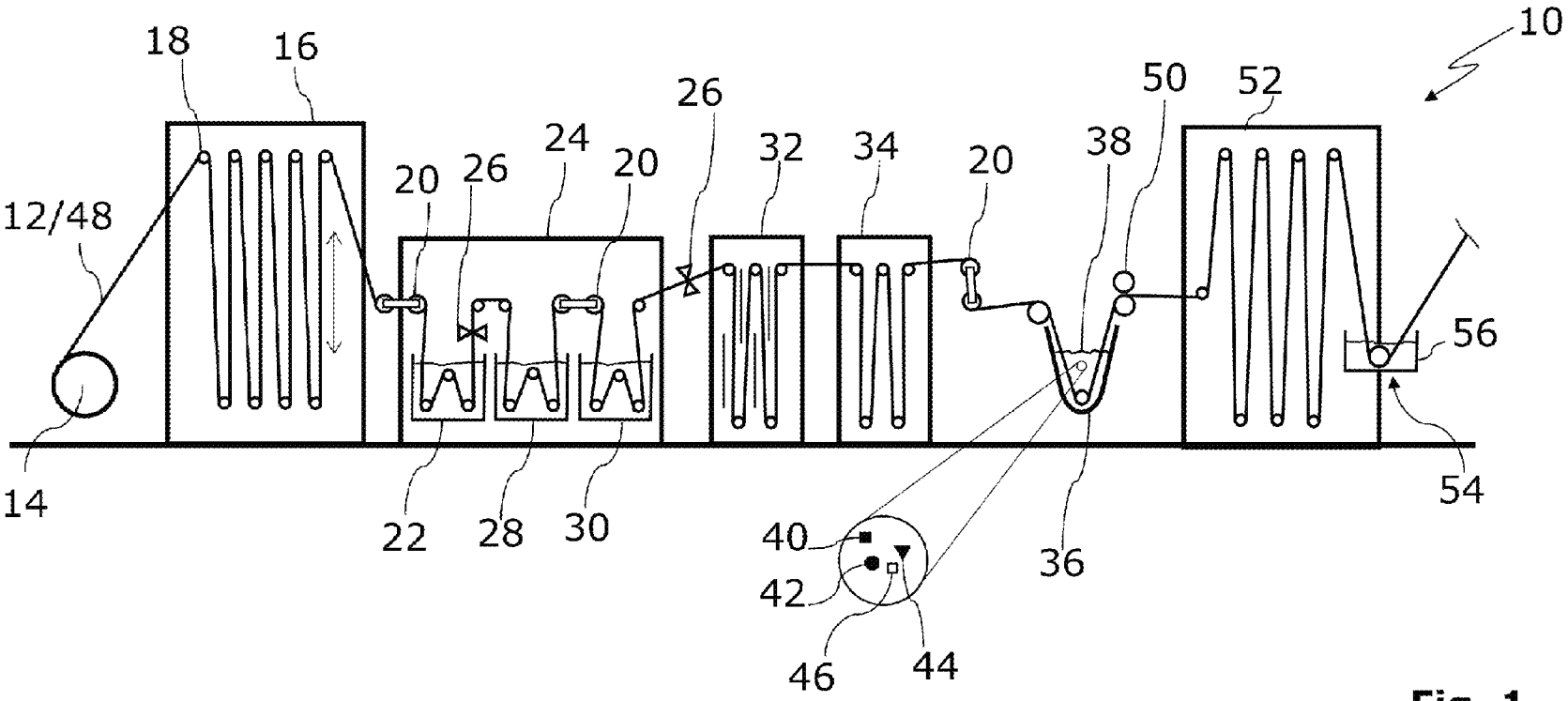
FIG. 1 schematically shows a longitudinal section through a first part of a dyeing system.

FIG. 1 schematically shows a longitudinal section through a first part of a dyeing system 10 for a Velcro® strap 12, wherein the Velcro® strap 12 undergoes a method for dyeing the Velcro® strap 12 in the dyeing system 10. The Velcro® strap 12 is continuously fed through the dyeing system 10 during the method.

In the dyeing system 10, the Velcro® strap 12 is moved from a drive wheel 14 to a fabric accumulator 16. Statements about the Velcro® strap 12 in connection with the method for dyeing the Velcro® strap 12 relate, in particular, to a partial section of the Velcro® strap 12, which is located on the drive wheel 14 at the beginning of the method and is unrolled from the drive wheel 14 as part of the method in order to undergo the process steps described below. Rollers 18 of the fabric accumulator 16 can be displaced relative to one another, in particular, in the vertical direction, wherein the fabric accumulator 16 can accommodate a partial strip of Velcro® strap 12 of different lengths depending on the position of the rollers 18. The fabric accumulator 16 thus serves as a memory and buffer for the Velcro® strap 12. After leaving the fabric accumulator 16, the Velcro® strap 12 is passed through a web edge control 20, which is designed to adjust the alignment of the Velcro® strap 12 for passing through the subsequent stations of the dyeing system 10.

From the web edge control 20, the Velcro® strap 12 passes through a first washing apparatus 22 of a washing system 24. The first washing apparatus 22 is filled with a cleaning solution (indicated by a curved line), which, in particular, has water, preferably exclusively water. In the first washing apparatus 22, the Velcro® strap 12 is washed at a temperature in the range of 40° C. to 70° C. This removes dirt spots on the Velcro® strap 12. In particular, avivage agents are washed out of the Velcro® strap 12 in the first washing apparatus 22. After passing through the first washing apparatus 22, the Velcro® strap 12 is passed through a vacuum extractor 26, which extracts the Velcro® strap 12 on both sides for the purpose of additional cleaning.

The Velcro® strap 12 then passes through a second washing apparatus 28 of the washing system 24. The second washing apparatus 28 is filled with a cleaning solution (indicated by a curved line), which, in particular, has water, preferably exclusively water. In the second washing apparatus 28, the Velcro® strap 12 is washed at a temperature in the range of 70° C. to 100° C. This relieves tension in the Velcro® strap 12 to make the Velcro® strap 12 more flexible and supple.

The Velcro® strap 12 then passes through another web edge control 20 to adjust its alignment. Thereafter, the Velcro® strap 12 is passed through a third washing apparatus 30 of the washing system 24, wherein the Velcro® strap 12 is quenched at a temperature in the range of 20° C. to 40° C. to maintain the Velcro® strap 12 in the flexible condition effected in the second washing apparatus 28. The third washing apparatus 30 is filled with a cleaning solution (indicated by a curved line), which, in particular, has water, preferably exclusively water.

After the washing system 24, the Velcro® strap 12 is passed through another vacuum extractor 26. In a subsequent step, the Velcro® strap 12 is passed through an infrared dryer 32. The infrared dryer 32 ensures that the Velcro® strap 12 dries evenly.

In the direction of movement of the Velcro® strap 12 behind the infrared dryer 32, the Velcro® strap 12 travels through a cooling path 34 in order to cool the Velcro® strap 12. This prevents undesirably early dyeing of the Velcro® strap 12, in particular, at a time when the Velcro® strap 12 first comes into contact with a dye 40, which is in particular formed as an acid dye, in a dyeing device 36 (see below). The alignment of the Velcro® strap 12 is then adjusted in another web edge control 20.

After the web edge control 20, the Velcro® strap 12 passes through the dyeing device 36, which is designed here as a dyeing trough. The dyeing device 36 contains a dyeing solution 38 which has a pH value of at least 7. The dyeing solution 38 is composed of at least the dye 40 and an acid donor 42, wherein the dye 40 is adapted to bind to the Velcro® strap 12 at a pH of less than 7. In particular, the dyeing solution 38 has a plurality of dyes 40, wherein each dye 40 serves to dye the Velcro® strap 12 in a respective color.

The acid donor 42 is designed to release acid at a critical value of a control parameter. The control parameter is, in particular, the temperature of the dyeing solution 12. In the dyeing device 36, the dyeing solution 12 has a starting value of the control parameter that is below the critical value of the control parameter. Therefore, the dyeing solution 12 in the dyeing device 36 does not bind to the Velcro® strap 12. This allows the dyeing solution 38 to be evenly distributed on the surface of the Velcro® strap 12. In particular, different dyes 40 may be prevented from binding to the Velcro® strap 12 at different rates so that the concentration of the dyes 40 on the Velcro® strap 12 deviates from a desired concentration of the dyes 40, thereby causing an undesirable overall color of the Velcro® strap 12. The critical value of the control parameter here is in particular a temperature value of 100° C. of the dyeing solution 38.

In addition, the dyeing solution 38 also contains, in particular, a first masking fabric 44 and a second masking fabric 46. At the initial value of the control parameter, the first masking fabric 44 binds to the dye 40 faster than a Velcro® material 48 of the Velcro® strap 12 binds to the dye 40. At the starting value of the control parameter, the second masking fabric 46 binds to the Velcro® material 48 of the Velcro® strap 12 faster than the dye 40 binds to the Velcro® material 48 of the Velcro® strap 12. The first and second masking fabrics 44, 46 prevent initial binding of the dye 40 to the Velcro® strap 12 so as to improve uniform distribution of the dyeing solution 38 on the surface of the Velcro® strap 12 in the dyeing device 36.

After the dyeing device 36, the Velcro® strap 12 is passed through Foulard rollers 50. A distance is formed between the Foulard rollers 50 such that dye 40 is wiped off the surface of the Velcro® strap 12 without damaging the structure of the Velcro® strap 12. In this process, excess dye 40 is removed from the Velcro® strap 12 and the application of dye 40 to the Velcro® strap 12 is further homogenized.

From the Foulard rollers 50, the Velcro® strap 12 passes into a damper 52, in which water vapor is present in the form of saturated steam. In this case, atmospheric oxygen is completely or almost completely removed from the damper 52. In the damper, the value of the control parameter is increased to the critical value. In particular, the Velcro® strap 12 is heated to at least 100° C. with the applied dyeing solution 38. The acid donor 42 releases acid in the damper 52 when the critical value is reached by the control parameter, in particular, when the dyeing solution 38 on the Velcro® strap 12 is heated to 100° C. The pH value of the coloring solution 38 drops to below 7. The first masking fabric 44 is formed such that the first masking fabric 44 in the damper 52 releases the dye 40 when the control parameter assumes the critical value, in particular, when the dyeing solution 38 in the damper 52 is heated to 100° C. The second masking fabric 46 is formed such that the second masking fabric 46 in the damper 52 is replaced by the dye 40 on the Velcro® material 48 when the control parameter assumes the critical value, in particular, when the dyeing solution 38 in the damper 52 is heated to 100° C. The lowering of the pH value of the dyeing solution 38 and the altered binding behavior of the masking fabrics 44, 46 in the damper 52 cause the dye 40 to bind to the Velcro® strap 12. The binding of the dye 40 to the Velcro® strap 12 takes place with uniform distribution and composition of the dye 40 on the surface of the Velcro® strap 12. This ensures that the Velcro® strap 12 is evenly colored.

At an output 54 of the damper 52, through which the Velcro® strap 12 is guided out of the damper 52, there is a surge drum 56, which is formed here as a water container filled with water (indicated by a curved line). The Velcro® strap 12 is guided through the water in the surge drum 56. The water in the surge drum remains transparent if no dye detaches from the Velcro® strap 12 and enters the water. Thus, the transparency of the water in the surge drum 56 is an indicator of whether the dye 40 is bound to the Velcro® strap 12 as intended.

Figure 2:
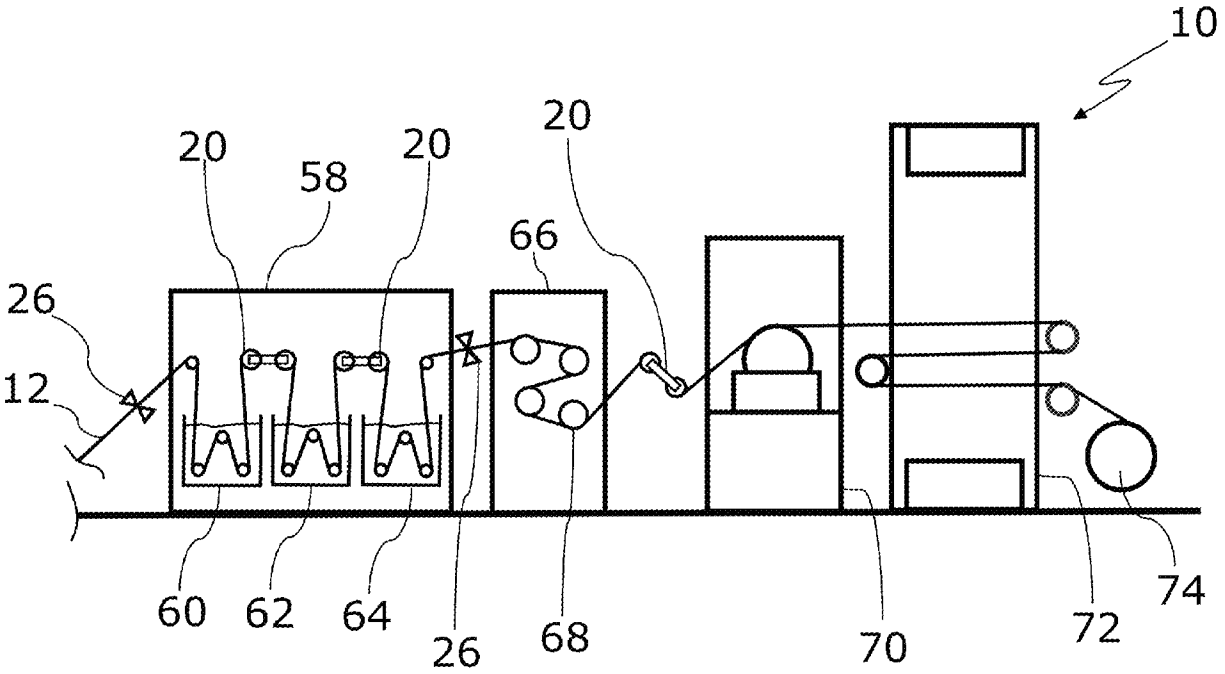
FIG. 2 schematically shows a longitudinal section through a first part of a dyeing system.

FIG. 2 shows schematically in longitudinal section a second part of the dyeing system 10, which adjoins the first part of the dyeing system 10 shown in FIG. 1 in the conveying direction of the Velcro® strap 12.

In the conveying direction of the Velcro® strap 12 behind the surge drum 56 (see FIG. 1), the Velcro® strap 12 is guided through a further vacuum extractor 26.

The Velcro® strap 12 then passes into a second washing unit of the other washing system 58 with a first washing unit 60, second washing unit 62 and third washing unit 64, which are designed here in the form of open containers in order to remove unbound dyeing solution 38 from the Velcro® strap 12. For this purpose, the washing units 60, 62 and 64 of the other washing system 58 each contain a cleaning agent, which is indicated in FIG. 2 by curved lines within the washing units 60, 62, 64. The cleaning agent comprises, in particular, water, preferably exclusively water. Between the first and second washing units 60, 62, the Velcro® strap 12 passes through a further web edge control 20. Between the second and third washing units 62, 64, the Velcro® strap 12 is guided by a further web edge control 20 to adjust the orientation of the Velcro® strap 12.

A further vacuum extractor 26 for cleaning the dyed Velcro® strap 12 is positioned behind the other washing system.

After the further vacuum extractor 26, the Velcro® strap 12 passes through a cylinder of the ironing system 66 with several, in particular, four, electrically heated cylinders 68 arranged in series, along which the Velcro® strap 12 is guided. This smooths the Velcro® strap 12 for subsequent coating processes. Behind the ironing system 66 there is a further web edge control 20 for adjusting the alignment of the Velcro® strap 12.

In the running direction of the Velcro® strap 12 behind the further web edge control 20, the Velcro® strap 12 is guided through a flat roller 70. The Velcro® strap 12 can be coated efficiently using the flat roller 70.

The Velcro® strap is then fed into a dryer 72, in which the Velcro® strap 12 is dried for further use.

The Velcro® strap 12 is rolled up behind the dryer 72 on other drive wheel 74 for further use.

Taking all the figures of the drawing together, the invention relates in summary to a method for dyeing a Velcro® strap 12, wherein the Velcro® strap 12 continuously passes through a basic or neutral dyeing solution 38 in a dyeing device 36. The dyeing solution 38 attaches itself to the Velcro® strap 12. The dyeing solution 38 has a dye 40 that binds to the Velcro® strap 12 only when the dyeing solution 38 is in an acidic state. After passing through the dyeing device 36, the Velcro® strap 12 with the deposited dyeing solution 38 is passed through a damper 52, causing the dyeing solution 38 to become acidic. The dye 40 adheres to the Velcro® strap 12 to dye the Velcro® strap 12. The invention also concerns a dyeing system 10 for implementing the method.

LIST OF REFERENCE SIGNS

10 dyeing system
12 Velcro® strap
14 drive wheel
16 fabric accumulator
18 rollers of the fabric accumulator
20 web edge control
22 first washing apparatus
24 washing system
26 vacuum extractor
28 second washing apparatus
30 third washing apparatus
32 infrared dryer
34 cooling path
36 dyeing device
38 dyeing solution
40 dye
42 acid donor
44 first masking fabric

46 second masking fabric
48 Velcro® material
50 Foulard rollers
52 damper
54 output of the damper
56 surge drum
58 other washing system
60 first washing unit of the other washing system
62 second washing unit of the other washing system
64 third washing unit of the other washing system
66 ironing system
68 cylinder of the ironing system
70 flat roller
72 dryer
74 other drive wheel

What is claimed is:

1. A method for dyeing a hook-and-loop fastener strap having hooks, mushrooms and/or loops, wherein said method having the following sequentially performed steps:

a) continuously passing the hook-and-loop fastener strap through a dyeing device to apply a dyeing solution with a pH value of at least 7 to the hook-and-loop fastener strap, wherein the dyeing solution has a dye, wherein the dye is formed as an acid dye which binds to the hook-and-loop fastener strap at a pH value of less than 7; and b) continuously passing the hook-and-loop fastener strap with the applied dyeing solution through a damper, wherein the pH value in the damper is lowered to below 7 to increase adhesion of the dye to the hook-and-loop fastener strap.

2. The method according to claim 1, wherein the dyeing solution has an acid donor designed to release acid at a critical value of a control parameter of the damper to lower the pH of the dyeing solution in the damper.

3. The method according to claim 2, wherein the control parameter is the temperature of the dyeing solution in the damper, wherein the critical value of the control parameter is in the range from 70° C. to 105° C.

4. The method according to claim 2, wherein the dyeing solution has a first masking fabric having an affinity to the dye in the dyeing device at the initial value of the control parameter which is greater than the affinity of a hook-and-loop fastener material of the hook-and-loop fastener strap to the dye, wherein in the damper at the critical value of the control parameter, the affinity of the first masking fabric to the dye is less than the affinity of the hook-and-loop fastener material of the hook-and-loop fastener strap to the dye.

5. The method according to claim 1, wherein the hook-and-loop fastener strap is washed in a first washing apparatus at a temperature of 40° C. to 70° C. before step a).

6. The method according to claim 5, wherein the hook-and-loop fastener strap is washed, before step a), in a second washing apparatus at a temperature of 70° C. to 100° C. after the hook-and-loop fastener strap has been washed in the first washing device.

7. The method according to claim 6, wherein the hook-and-loop fastener strap is washed, before step a), in a third washing apparatus at a temperature of 20° C. to 40° C. after the hook-and-loop fastener strap has been washed in the second washing apparatus.

8. The method according to claim 1, wherein the control parameter is the temperature of the dyeing solution, wherein the critical value of the control parameter in the damper is in the range from 70° C. to 105° C.

9. The method according to claim 1, wherein the hook-and-loop fastener strap has polyamide formed from polyamide.

10. The method according to claim 1, wherein the hook-and-loop fastener strap is continuously passed between two foulard rollers to wipe off excess dyeing solution after the hook-and-loop fastener strap has been passed through the dyeing device according to step a) and before the hook-and-loop fastener strap is passed through the damper according to step b).

11. The method according to claim 1, wherein the dyeing solution has a caustic solution, being soda, wherein the pH of the dyeing solution in the dyeing device is at least 7.

12. The method according to claim 1, wherein the dyeing solution has a defoamer.

13. The method according to claim 1, wherein the hook-and-loop fastener strap passes through a surge drum when leaving the damper.

14. The method according to claim 1, wherein the hook-and-loop fastener strap passes through a vacuum unit.

15. The method according to claim 1, wherein the thickness of the layer of the dye on the hook-and-loop fastener strap does not exceed a predetermined maximum thickness and/or does not fall below a predetermined minimum thickness after running through the method over a predetermined length of the hook-and-loop fastener strap.

16. A dyeing system for carrying out the method according to claim 1, wherein the dyeing system has:

I) the dyeing device with the dyeing solution having a pH value of at least 7, wherein the dyeing solution has the dye, wherein the dye is formed as the acid dye which binds to the hook-and-loop fastener strap at a pH value of less than 7;

II) the damper, wherein the damper is configured to lower the pH of the dyeing solution to below 7 to increase adhesion of the dye to the hook-and-loop fastener strap; and III) the hook-and-loop fastener strap, wherein the hook-and-loop fastener strap is passed through the dyeing device and the damper.

* * * * *